US006505561B1

(12) United States Patent
Dietrich

(10) Patent No.: US 6,505,561 B1
(45) Date of Patent: Jan. 14, 2003

(54) METHOD AND APPARATUS FOR INDUCING ROTATION OF A DISPENSED PAYLOAD FROM NON-SPIN PROJECTILES

(75) Inventor: Mark C. Dietrich, Tucson, AZ (US)

(73) Assignee: Raytheon Company, Lexington, MA (US)

( * ) Notice: Subject to any disclaimer, the term of this patent is extended or adjusted under 35 U.S.C. 154(b) by 0 days.

(21) Appl. No.: 09/843,011

(22) Filed: Apr. 25, 2001

(51) Int. Cl.[7] ..... F42B 12/36
(52) U.S. Cl. ..... 102/489; 102/357; 102/393
(58) Field of Search ..... 102/340, 342, 102/351, 357, 393, 489, 527; F42B 12/58, 12/62

(56) References Cited

U.S. PATENT DOCUMENTS 3,771,455 A * 11/1973 Haas ..... 102/489
3,786,760 A * 1/1974 Feldmann ..... 102/527
4,036,140 A * 7/1977 Korr et al. ..... 102/438
4,676,167 A * 6/1987 Huber, Jr. et al. ..... 102/393
4,770,101 A * 9/1988 Robertson et al. ..... 102/393
4,922,826 A * 5/1990 Busch et al. ..... 102/489
5,005,481 A * 4/1991 Schneider et al. ..... 102/393
5,005,483 A * 4/1991 Deffayet ..... 102/489

FOREIGN PATENT DOCUMENTS

FR 477375 * 10/1915 ..... 102/489

* cited by examiner

*Primary Examiner*—Harold J. Tudor
(74) *Attorney, Agent, or Firm*—Colin M. Raufer; Leonard A. Alkov; Glenn H. Lenzen, Jr.

(57) ABSTRACT

A method an apparatus for inducing spin, or rotation, in a dispersed payload of a non-spin guided projectile is taught. Rifling is applied to a cylindrical surface of a projectile casing. The rifling engages a member on a payload, which may be a bulkhead, as the payload is expelled from the projectile casing. The rotation imparted to the payload causes the dispersed projectile, grenades in the preferred embodiment, to form a spiral pattern that provides a more uniform coverage of the target area as compared to the prior art.

16 Claims, 1 Drawing Sheet

METHOD AND APPARATUS FOR INDUCING ROTATION OF A DISPENSED PAYLOAD FROM NON-SPIN PROJECTILES

BACKGROUND OF THE INVENTION

1. Field of the Invention

The present invention relates to munitions. More specifically, the present invention relates to dispensed payload munitions.

2. Description of the Related Art

Guided projectile munitions are advantageously utilized in the art. Such devices have been developed which are non-spin stabilized because the guidance of a non-spin device is more readily achievable than guidance of the spin stabilized variety of munitions. However, the use of non-spin stabilized munitions does create certain disadvantages in the dispersal of payloads upon delivery of the munitions to a target area.

In the case of munitions that deliver a plurality of grenades to a target location, a uniform grenade dispersal pattern is a key criterion with respect to the effectiveness of such munitions and delivery systems. Since guided projectile munitions are usually non-spin stabilized to effect proper guidance, the delivery of the payload is accomplished without the benefit of the rotation present in spin stabilized munitions. Prior art methods of grenade dispersal for non-spin projectiles produce a spoke type pattern on the target. The grenades are dispersed along lines which form expanding angles from the pattern center. This type of pattern leaves large voids at the extreme pattern edges, and renders the munitions coverage less uniform, and therefore less effective, than may otherwise be possible.

If the munitions is spinning, or rotating, at the moment when the payload of grenades is dispersed, then the pattern generated is spiral shaped and tends to overcome the problem with the aforementioned voids in the pattern. For this reason, non-spin dispersing projectiles are somewhat rare in practice. Previous attempts at overcoming this problem by combining non-spin munitions, which disperse a plurality of grenades, have involved inducing a rotation to the entire projectile at dispersal. Such an approach, however, invariably leads to a more complicated and expensive device.

Therefore, a method or apparatus that can induce spin, or rotation, at the point of dispersal would be advantageous, and a need exists in the art for such a device or method that can be achieved with low cost and low complexity.

SUMMARY OF THE INVENTION

The need in the art is addressed by the teachings of the present invention. In a first illustrative embodiment, an apparatus for dispensing payload in munitions is taught. The apparatus has a casing with a rifled cylindrical portion, and a payload located within the casing and that slides out of the casing. The payload has a member that engages the rifled cylindrical portion. A means for expelling the payload from the casing is provided that imparts rotation upon the payload with respect to the cylindrical portion by the rifling. In a refinement of the foregoing embodiment, the means for expelling the payload is gas pressure. In another refinement, the means for expelling is payload expulsion gases. In another refinement, the member is a bulkhead on the payload. In another refinement, the bulkhead is circular. In another refinement, the circular bulkhead has a plastic band about its periphery. In another refinement, the plastic band is nylon. In another refinement, the payload further comprises a plurality of grenades, and the imparted rotation of the payload causes the dispersal of the grenades in a spiral pattern. In another refinement, the cylindrical portion is an outer wall of the casing, and the rifling is formed on an internal surface of the outer wall. In another refinement, the rifling is formed as spiral grooves dispersed upon the inner surface. In another refinement, the rifling is formed as spiral ridges dispersed upon the inner surface. In another refinement, the apparatus is an artillery shell. In another refinement, the apparatus is a guided projectile. In another refinement, the apparatus is a rocket. In another refinement, the apparatus is a non-spin stabilized projectile.

The present invention also teaches a method of imparting rotation upon the payload of a dispersed payload munitions that has a casing with a rifled cylindrical portion and a payload slideably located within the casing and, where the payload has a member engaging the rifling. The method comprises the steps of delivering the casing and payload to a target destination, and expelling the payload from the casing. This action imparts rotation upon the payload with respect to the casing by the rifling. In a refinement of this method, the delivering step is accomplished by firing the payload and casing from a gun. In another refinement, the delivering step is accomplished by incorporating the casing and payload into a rocket. In another refinement, the delivering step is accomplished by incorporating the casing and payload into a bomb. In another refinement, the expelling step is accomplished with gas pressure.

The present invention also teaches a method of dispensing a plurality of grenades into a spiral pattern from a munition that has a casing with a rifled cylindrical portion and a payload that houses the plurality of grenades, where the payload has a member slideably engaging the rifling. This method comprises a first step of delivering the casing and payload to a target destination. Then, expelling the payload from the casing, and thereby imparting rotation upon the payload with respect to the casing by the rifling. Finally, dispensing the plurality of grenades from the payload.

BRIEF DESCRIPTION OF THE DRAWINGS

The FIGURE is a cut-away perspective view of an illustrative embodiment of the present invention.

DESCRIPTION OF THE INVENTION

Figure 1:
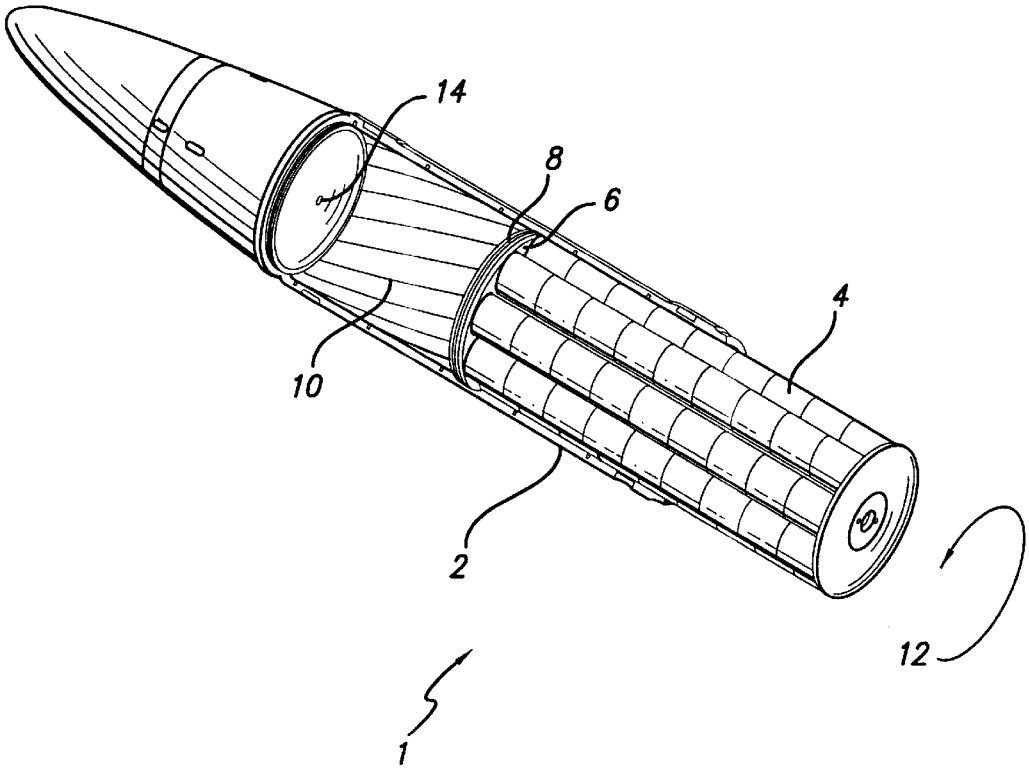

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

The present invention teaches a novel apparatus and method for imparting angular momentum into the separating payload section of a projectile, which is otherwise designed to have little if any spin or rotation. This is typically the case in a non-spin stabilized guided projectile, as are understood by those of ordinary skill in the art. The preferred embodiment of the present invention involves a projectile designed to disperse a plurality of grenades at a target location. However, the present teachings are equally useful in any other payload carrying projectile designed to disperse its payload.

The application of the teachings of the present invention supplant the typical energy transfer to the payload grenades, normally provided in a high spin projectile environment. Thus, the present invention enhances the grenade dispersion pattern by generating a spiral pattern eliminating the aforementioned voids in the prior art approaches. In one embodiment of the present invention, rifling machined into the interior wall of the projectile payload body is engaged by a nylon band affixed to the forward bulkhead of the payload. As the payload expel gasses force the payload out of the projectile body casing, rotation is induced in the expelled payload. This rotation enhances the grenade pattern by producing a spiral pattern when the grenades are dispensed in the typical fashion, as is understood by those of ordinary skill in the art.

The present invention advantageously utilizes existing forces in a dispense system, which are the expulsion gasses used in the prior art to eject and dispense the payload, to induce the payload rotation. A particular advantage of the present invention is the low cost of implementation. This is because the present invention only requires the machining of rifling on the interior surface of the projectile casing and the addition of a nylon band on the payload bulkhead, that engages the rifling, to implement. Thus, the invention produces rotation of a dispensed grenade payload by engaging rifling on the interior payload body, or casing, wall with a nylon band affixed to the payload assembly's forward bulkhead. As the expulsion gasses expand, forcing the payload out of the projectile, the payload is rotated with respect to the casing. The angular velocity of the payload is a function of the relative inertia between the payload and the projectile casing, the pitch of the rifling, and the linear velocity of the dispensing payload. The rotating payload, once free of the projectile body, then dispenses the grenades in the typical expanding bladder manner, as is understood by those of ordinaryl skill in the art. As the grenades ale expelled from the rotating payload assembly, a spiral type pattern is generated at the ground target. The pattern is thus a function of altitude, linear velocity of the grenades, and the angular velocity of the payload assembly. Those of skill in the art will understand how these variables can be manipulated to achieve the desired operational parameters.

An illustrative embodiment appears as a perspective view in the FIGURE. The FIGURE shows an illustrative embodiment of the invention in connection with a rocket, a bomb, an artillery shell or other guided projectile. The casing 2 of a non-spin guided projectile 1 has a payload 4 that is slideably located within the casing 2 at the time of delivery to a target area. The payload 4 in the preferred embodiment comprises a Plurality of grenades that are deployed when the projectile 1 reaches a target area.

As is understood by those of ordinary skill in the art, the payload 4 is deployed and dispersed by forcing the payload 4 out of the aft end of the casing 2 by expulsion gasses that enter the interior of the casing 2 through expel gas port 14. The pressure of the gas forces the payload 4 out the aft end of the projectile 1. As this occurs, a bladder (not shown) in the payload forces the grenades out and away from the payload, thus creating a pattern of dispersion of the grenades into the vicinity of the target area. In order to maintain expel gas pressure, the payload is fitted with a bulkhead 6 at the fore end. Thus, the expel gasses are trapped inside of the casing 2 by the bulkhead 6. The bulkhead 6 is attached to the payload, so that it is ultimately expelled from the casing 2 by the expel gasses.

The present invention advantageously utilizes the existing expel gas forces to not only expel the payload 4 so as to disperse the grenades, but also to impart a spin, or rotation 12, to the expelled payload. This is accomplished by machining rifling 10 onto the inner surface of the casing 2. This rifling can be formed as grooves in the casing surface, or as ridges in the casing surface. Note that optimum performance is achieved where the bore of the casing is round and cylindrical so that the rotation of the payload with respect to the casing does not induce any loss of expel gas pressure or any increase in friction due to the expulsive motion of the payload. The bulkhead 6 on the payload, as utilized in prior art designs, is not well suited to engage the rifling of the present invention. The bulkhead design can be adapted to engage the rifling in a number of ways. In an illustrative embodiment, a plastic band 8 is added to the periphery of the bulkhead 6 so that the rifling effectively engages the bulkhead to impart rotation 12 thereto. In the preferred embodiment, the plastic band is fabricated from nylon.

When the payload 4 is expelled from the projectile casing 2, a rotation 12 is imparted between the rifling and the bulkhead, which is connected to the payload. Since this action occurs in free space (affected primarily by air and wind) the rotation of the two objects is with respect to one another only. However, those skilled in the art will appreciate that the rotation of the payload 4 with respect to the target ground area is that part of the energy transferred to the payload 4 only. Therefore, the mass, and moment of inertia of the payload 4 and casing 2, as well as the velocity, expel gas pressure, and pitch of the rifling can be readily manipulated to achieve the desired spiral pattern of the grenades on deployment.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such applications, modifications and embodiments within the scope of the present invention.

Accordingly,

What is claimed is:

1. An apparatus for dispensing munitions from a non-spin stabilized projectile, comprising:

a casing having a rifled cylindrical portion;

a payload slideably located within said casing, said payload having a member engaging said rifled cylindrical portion, and a gas powered arrangement for expelling said payload from said casing thereby imparting rotation of said payload with respect to said cylindrical portion by said rifling and for directly expelling said munitions from said payload.

2. The apparatus of claim 1 wherein said arrangement for expelling is payload expulsion gases.

3. The apparatus of claim 1 wherein said member is a bulkhead.

4. The apparatus of claim 3 wherein said bulkhead is circular.

5. The apparatus of claim 4 wherein said circular bulkhead has a plastic band about its periphery.

6. The apparatus of claim 5 wherein said plastic band is nylon.

7. The apparatus of claim 1 wherein said cylindrical portion is an outer wall of said casing, and said rifling is formed on an internal surface of said outer wall.

8. The apparatus of claim 7 wherein said rifling is formed as spiral grooves dispersed upon said inner surface.

9. The apparatus of claim 7 wherein said rifling is formed as spiral ridges dispersed upon said inner surface.

10. The apparatus of claim 1 wherein said apparatus is an artillery shell.

11. The apparatus of claim 1 wherein said apparatus is a guided projectile.

12. The apparatus of claim 1 wherein said apparatus is a rocket.

13. A method of imparting rotation upon the payload of a dispersed payload munitions having a casing with a rifled cylindrical portion and a payload slideably located within the casing, the payload having a member engaging the rifling, comprising the steps of:

delivering the casing and payload to a target destination with a non-spin stabilized projectile;

expelling the payload from the casing using gas pressure, and thereby imparting rotation upon the payload with respect to the casing by the rifling; and expelling munitions from said payload using said gas pressure.

14. The method of claim 13 wherein said delivering step is accomplished by firing the payload and casing from a gun.

15. The method of claim 13 wherein said delivering step is accomplished by incorporating the casing and payload into a rocket.

16. The method of claim 13 wherein said delivering step is accomplished by incorporating the casing and payload into a bomb.

* * * * *